US011826888B2

(12) United States Patent
Solomon

(10) Patent No.: US 11,826,888 B2
(45) Date of Patent: Nov. 28, 2023

(54) LOCKING WRENCH PLIERS

(71) Applicant: Asaf Solomon, Alon Hagalil (IL)

(72) Inventor: Asaf Solomon, Alon Hagalil (IL)

( * ) Notice: Subject to any disclaimer, the term of this patent is extended or adjusted under 35 U.S.C. 154(b) by 638 days.

(21) Appl. No.: 16/960,104

(22) PCT Filed: Jan. 8, 2019

(86) PCT No.: PCT/IL2019/050035
§ 371 (c)(1),
(2) Date: Jul. 6, 2020

(87) PCT Pub. No.: WO2019/138403
PCT Pub. Date: Jul. 18, 2019

(65) Prior Publication Data

US 2021/0060736 A1 Mar. 4, 2021

Related U.S. Application Data

(60) Provisional application No. 62/615,452, filed on Jan. 10, 2018.

(51) Int. Cl.

| | |
|---|---|
| ***B25B 7/18*** | (2006.01) |
| ***B25B 5/12*** | (2006.01) |
| ***B25B 5/16*** | (2006.01) |
| ***B25B 7/02*** | (2006.01) |
| ***B25B 7/12*** | (2006.01) |
| ***B25B 13/46*** | (2006.01) |

(52) U.S. Cl.
CPC ..... *B25B 7/18* (2013.01); *B25B 5/12* (2013.01); *B25B 5/163* (2013.01); *B25B 7/02* (2013.01); *B25B 7/123* (2013.01); *B25B 13/461* (2013.01)

(58) Field of Classification Search
CPC .... B25B 7/18; B25B 7/02; B25B 7/00; B25B 7/14; B25B 5/12; B25B 5/163
See application file for complete search history.

(56) References Cited

U.S. PATENT DOCUMENTS

| | | | | |
|---|---|---|---|---|
| 1,817,988 A | | 8/1931 | Klamt | |
| 4,438,668 A | * | 3/1984 | Solomon | B25B 7/12 81/352 |
| 4,519,278 A | * | 5/1985 | Heldt | B25B 7/123 81/367 |
| 4,911,040 A | | 3/1990 | Kim | |
| 6,012,362 A | * | 1/2000 | Wang | B25B 7/123 81/380 |
| 6,092,440 A | * | 7/2000 | Hillinger | B25B 13/28 81/99 |

(Continued)

*Primary Examiner* — Seahee Hong
(74) *Attorney, Agent, or Firm* — Mark David Torche; Patwrite Law

(57) ABSTRACT

Embodiments of the current invention relate to a pliers wrench. Optionally, the jaws of the pair of pliers lock to an adjustable gap size and/or the gap between the jaws is aligned with a rotational axis of the pair of pliers. For example, there may be two jaws that adjust symmetrically around the rotational axis. In some embodiments, each jaw is closed toward an opposing jaw by a lever. Optionally, a locking mechanism locks the jaw when it reaches half the gap width from the rotational axis. Optionally, each jaw is closable independently of the other jaw. Optionally, a notch in the jaws forms an angle for clasping a bolt perpendicular to an axis of the device. For example, the notch may have a 120 angle.

11 Claims, 13 Drawing Sheets

(56) References Cited

U.S. PATENT DOCUMENTS

| | | | | |
|---|---|---|---|---|
| 7,104,166 | B1 * | 9/2006 | Wong | B25B 7/123 81/180.1 |
| D571,631 | S * | 6/2008 | Gandy, III | D8/74 |
| 9,463,555 | B1 | 10/2016 | Hile | |
| 10,919,130 | B2 * | 2/2021 | Berglund | B25B 7/02 |
| 2003/0196526 | A1 * | 10/2003 | Wang | B25B 7/02 81/367 |

* cited by examiner

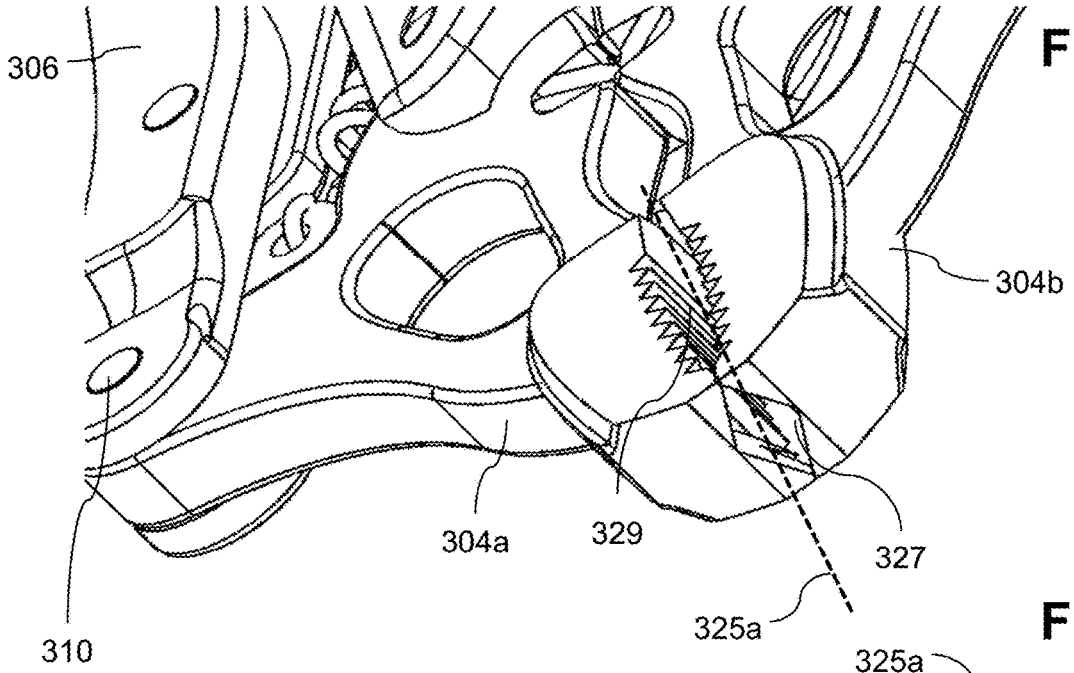
FIG. 6
FIG. 7
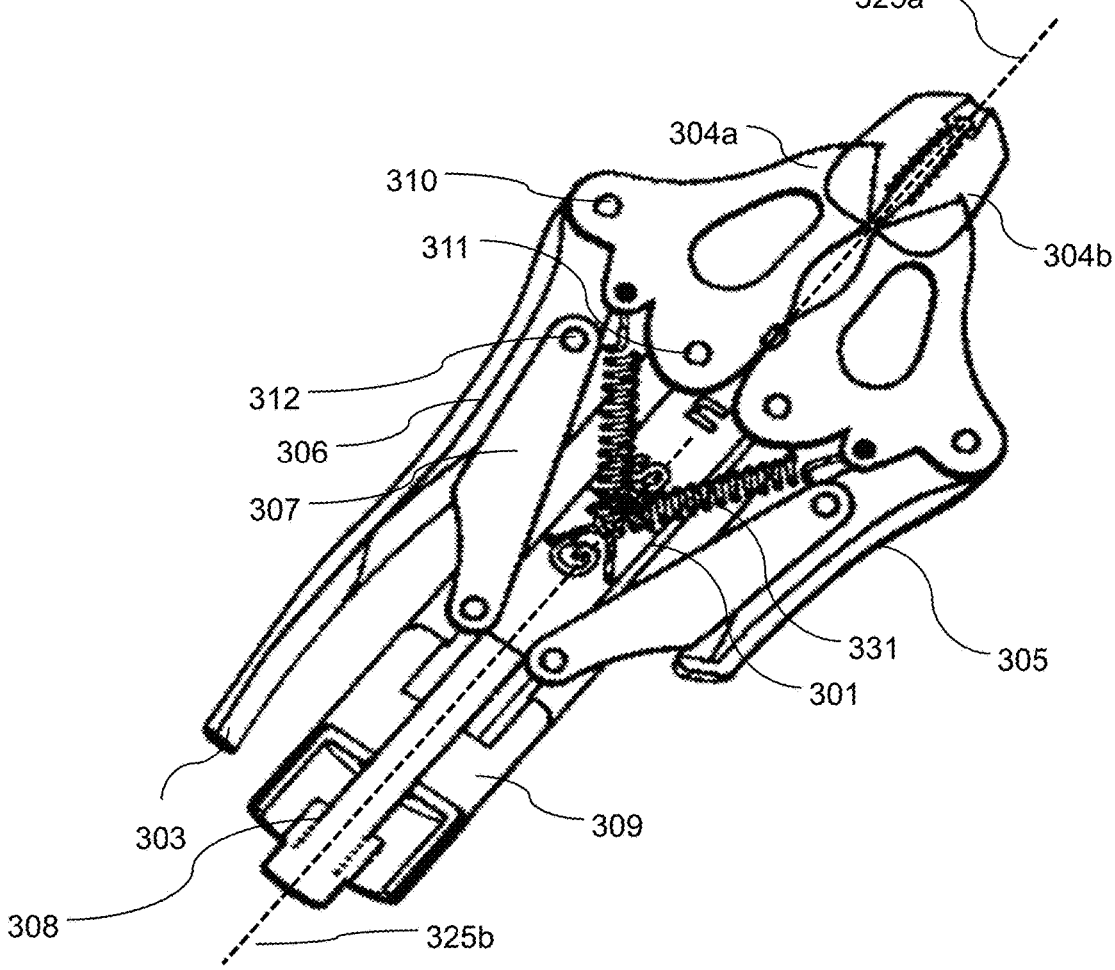

LOCKING WRENCH PLIERS

RELATED APPLICATION/S

This application claims the benefit of priority under 35 USC § 119(e) of U.S. Provisional Patent Application No. 62/615,452 filed 10 Jan. 2018, the contents of which are incorporated herein by reference in their entirety.

FIELD AND BACKGROUND OF THE INVENTION

The present invention, in some embodiments thereof, relates to wrench pliers and, more particularly, but not exclusively, to an adjustable wrench that can be locked to a bolt like a pair of pliers.

U.S. Pat. No. 2,397,095 apparently discloses a, "wrench with means for automatically locking its jaws upon the work to which said jaws are applied and with means whereby said jaws may be readily moved apart to other objects . . . "

U.S. Pat. No. 7,143,671 apparently discloses, "a lever-wrench pliers, which includes a fixed jaw tip that define a mouth and has three clamping faces around the mouth, and a movable jaw that has a jaw tip with a toothed clamping face facing the middle one of the three clamping faces of the fixed jaw tip."

U.S. Pat. No. 7,191,525 appears to disclose that, "A two-stage attachment includes two stages of levers arranged to apply a cutting, shearing, squeezing and/or piercing force. The first stage includes a cam lever that has a segmented arcuate pushing surface. The second stage includes a blades support that has an arcuate yielding surface. The pushing surface contacts the yielding surface such that force applied to the cam lever is transmitted to the blade support through the contact between the surfaces."

SUMMARY OF THE INVENTION

According to an aspect of some embodiments of the invention, there is provided a gripping tool including: a rotational axis; a pair of jaws arranged symmetrically around the rotational axis; a single adjustment mechanism simultaneously controlling adjustment of each jaw of the pair of jaws symmetrically around the rotational axis.

According to some embodiments of the invention, the gripping tool further includes a pair of handles wherein each handle of the pair of handles is linked to a separate respective jaw of the pair of jaws and wherein closing the pair of handles towards each other closes the pair of jaws to a closed position and wherein the single adjustment mechanism adjusts a location of each jaw at the closed position.

According to some embodiments of the invention, the pair of handles includes a long handle and a shorter handle.

According to some embodiments of the invention, a first handle of the pair of handles is entirely on a first side of the rotational axis and a second handle of the pair of handles is on an opposite side of the rotational axis.

According to some embodiments of the invention, the gripping tool further includes: a separate closing mechanism for each jaw of the pair of jaws; and a single adjustment mechanism linked to the separate closing mechanism of each jaw thereby simultaneously controlling symmetric adjustment of each jaw of the pair of jaws.

According to some embodiments of the invention, at least one the separate closing mechanism includes a locking mechanism for locking a respective jaw in a closed position.

According to some embodiments of the invention, the gripping tool further includes: a body and wherein each jaw is attached to the body by a respective rotational pivot.

According to some embodiments of the invention, the rotational axis is a longitudinal axis of the body.

According to some embodiments of the invention, a respective rotation pivot of a first jaw of the pair of jaws is positioned symmetrically to a respective rotational pivot of a second jaw of the pair of jaws across the rotational axis of the tool.

According to some embodiments of the invention, the gripping tool further includes a rotational mechanism for rotating the body about the rotational axis.

According to some embodiments of the invention, the rotational mechanism includes at least one component selected from the group consisting of a ratchet, a fitting symmetric to the rotational axis, a central post and a rotational handle.

According to some embodiments of the invention, in a closed position the jaws define a gap and wherein a size of the gap is adjusted by the adjustment mechanism and wherein a central axis of the gap remains stationary with respect to the body for a range of gap sizes.

According to some embodiments of the invention, the body includes a rotational axis and wherein the central axis of the gap remains coaxial with the rotational axis for the range of gap sizes.

According to some embodiments of the invention, the jaws include a notch having a 120-degree angle configured to hold a hex head bolt with an axis of the bolt coaxial to the gap.

According to some embodiments of the invention, in a closed position the jaws define a gap and wherein a size of the gap is adjusted by the adjustment mechanism and wherein a central axis of the gap is coaxial with the rotational axis for a range of gap sizes.

According to some embodiments of the invention, the range includes gap sizes from 5 mm to 2 cm.

According to some embodiments of the invention, the jaws include a notch having a 120-degree angle.

According to an aspect of some embodiments of the invention, there is provided a method of rotating an object including: adjusting a locking pair of pliers to lock with a gap between closed jaws of the pair of pliers fitting the object while keeping the gap aligned with a rotational axis of the pair of pliers; closing the jaws onto the object with the object coaxial with respect to the rotational axis of the pair of pliers.

According to some embodiments of the invention, each jaw of the jaws is linked to a separate handle of a pair of handles and the closing includes closing at least one handle of the pair of handles towards an opposite handle of the pair of handles.

According to some embodiments of the invention, the method further includes: locking the jaws in a closed position.

According to some embodiments of the invention, the pair of pliers has a rotational axis and wherein in the closed position the pair of jaws are positioned symmetrically around the rotational axis.

According to some embodiments of the invention, the pair of pliers has a rotational axis and wherein when grasped in the closed position the jaws are positioned symmetrically around the rotational axis.

According to some embodiments of the invention, the method further includes: rotating the pair of pliers and the object about the rotational axis of the pair of pliers.

According to some embodiments of the invention, the rotating the pair of pliers and the object about the rotational axis of the pair of pliers also includes rotating the object around a longitudinal axis thereof.

According to some embodiments of the invention, the method further includes: wherein the closing includes rotating at least one jaw of the jaws around a pivot.

According to some embodiments of the invention, the pair of pliers include a body and the pivot attaches the at least one jaw to the body of the pair of pliers.

According to some embodiments of the invention, the rotational axis is a longitudinal axis of the body and the rotating includes rotating around the longitudinal axis of the body.

According to some embodiments of the invention, the pair of pliers include a body and each jaw of the jaws is attached to the body by a respective pivot and where a first the respective pivot is situated symmetrically opposite a second the respective pivot with respect to the rotational axis and wherein the closing includes rotating at least one of the jaws around the respective pivot of the at least one jaw.

According to some embodiments of the invention, the rotating includes rotating a ratchet.

According to some embodiments of the invention, the jaws include a notch having a 120 degree angle the method further including: holding a hexagonal fitting of the object in the notch.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIG. 6 is a perspective close up view of jaws of a locking pliers wrench in accordance with an embodiment of the current invention;

FIG. 7 is a cross sectional side view of a locking pair of pliers in accordance with an embodiment of the current invention;

DESCRIPTION OF SPECIFIC EMBODIMENTS OF THE INVENTION

Figure 1:
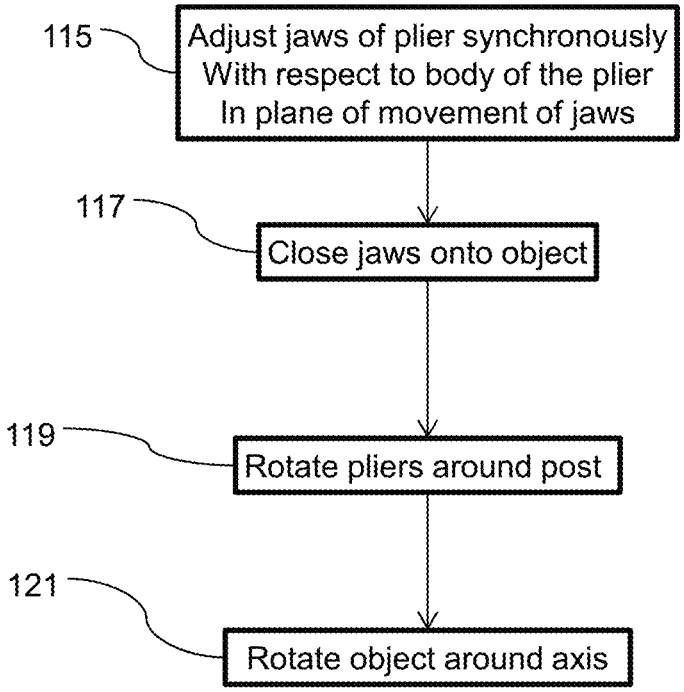
FIG. 1 is a flow chart illustration of a method of rotating a screw in accordance with an embodiment of the current invention.

The present invention, in some embodiments thereof, relates to a wrench pliers and, more particularly, but not exclusively, to an adjustable wrench that can be locked to a bolt like a pair of pliers.

Overview:

An aspect of some embodiments of the current invention relates to a pliers wrench. Optionally, the jaws of the pair of pliers lock to an adjustable gap size and/or the gap between the jaws is aligned with an axis of the pair of pliers. For example, there may be two jaws that adjust symmetrically around the axis. In some embodiments, the pair of pliers includes a central post and/or a twisting member. Optionally, when a bolt is gripped in the pair of pliers, the central axis of the bolt is aligned with the post of the pair of pliers and/or with the rotational axis of the twisting member. In some embodiments, each jaw is closed toward an opposing jaw by a lever and/or a handle. Optionally, a locking mechanism locks the jaw when it reaches half the gap width from the central axis. In some embodiments, for example when an object is grasped while one jaw already locked by moving a second jaw to close upon the object, the second jaw will close and/or lock slightly more or less than ½ the gap width (e.g. because the object is slightly bigger and/or smaller than the empty gap width). For example, the jaw may close and/or lock at between 49 to 50% of the gap width and/or between 50 to 51% and/or between 47 to 50% and/or between 50 to 53% and/or between 45 to 50% and/or between 50 to 55% the unloaded gap width. Optionally, each jaw is closable independently of the other jaw. Optionally, a notch in the jaws forms an angle for clasping a bolt perpendicular to an axis (e.g. the longitudinal axis) of the device. For example, the notch may have a 120 angle. Optionally, opposing jaws may include aligned notches. Optionally the axis is perpendicular to an axis of rotation of a jaw of the plier and/or in a plane of movement of the jaws. In some embodiments, the pair of pliers includes a post and/or a ratchet mechanism and/or a ratchet key aligned with the axis for rotating the pair of pliers around the axis.

In some embodiments, for a range of gap widths the jaws of the pair of pliers may remain symmetrically positioned around a rotational axis of the pair of pliers and/or a longitudinal axis of the pair of pliers. Optionally, handles may be used to open and close each jaw independently. Optionally the handles are positioned on opposite sides of the rotational axis. Optionally, each jaw may be rotationally mounted to a respective pivot on a body of the wrench.

Optionally the respective pivots of opposing jaws may be positioned symmetrically on opposite sides of the rotational axis of the pair of pliers.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

FIG. 1 is a flow chart illustration of a method of rotating 121 a screw (and/or a similar object) in accordance with an embodiment of the current invention. Optionally, a pair of pliers is provided having jaws that move with respect to a stationary body and/or rotational axis of the pair of pliers. Optionally the body has a longitudinal axis that corresponds to the rotational axis. In some embodiments, the jaws are adjusted 115 to close and/or lock to a gap fitting a head of the screw (for example between 99 to 100% the size of the head and/or between 100 to 101% and/or between 97 to 100% and/or between 100 to 103% and/or between 95 to 100% and/or between 100 to 105%. In some embodiments, the jaws are adjusted 115 synchronously around the rotational axis (e.g. for a range of gap sizes [e.g. from 1 mm to 5 mm and/or from 5 mm to 2 cm and/or from 2 cm to 5 cm and/or from 5 cm to 15 cm], when the jaws are closed, the rotational axis passes through the middle of the gap). Optionally, the jaws are closed 117 and/or locked to grip a head of the screw. For example, the closing 117 and/or locking may result from closing a lever. Optionally, one or more of the jaws may move in a plane of the rotational axis and/or rotate around a pivot perpendicular to the rotational axis. Optionally, when the jaws are closed and/or locked onto the screw, a rotational axis of the pair of pliers corresponds to a central longitudinal axis of the screw. Optionally the pair of pliers is rotated 119 around their rotational axis and/or the screw is rotated 121 around its central longitudinal axis.

In some embodiments, the jaws may close onto and/or grasp an object other than a screw. For example, the jaws may be used to grasp a screw driver and/or a socket wrench and/or a pipe fitting.

In some embodiments, jaws are closed by closing fingers on the palm of the hand around one or more lever handles. Optionally, one jaw is closed against another to grasp an item. Optionally, a handle is longer than the jaw of a pair of pliers and/or mechanical advantage may be produced by lever arms and/or links. For example, the force exerted on the jaws may be stronger than the force on the lever handle.

In some embodiments, of the current invention jaws can be adjusted, for example to grasp different size object. In some adjustable pliers, there is a mobile jaw and a fixed jaw and/or the axis of the jaws move when the pliers are adjusted to hold objects of different sizes. Optionally, in some embodiments of the current invention, both jaws can be adjusted and/or moved, for example to grasp objects of different sizes while the axis of the jaws remains fixed.

Figure 2:
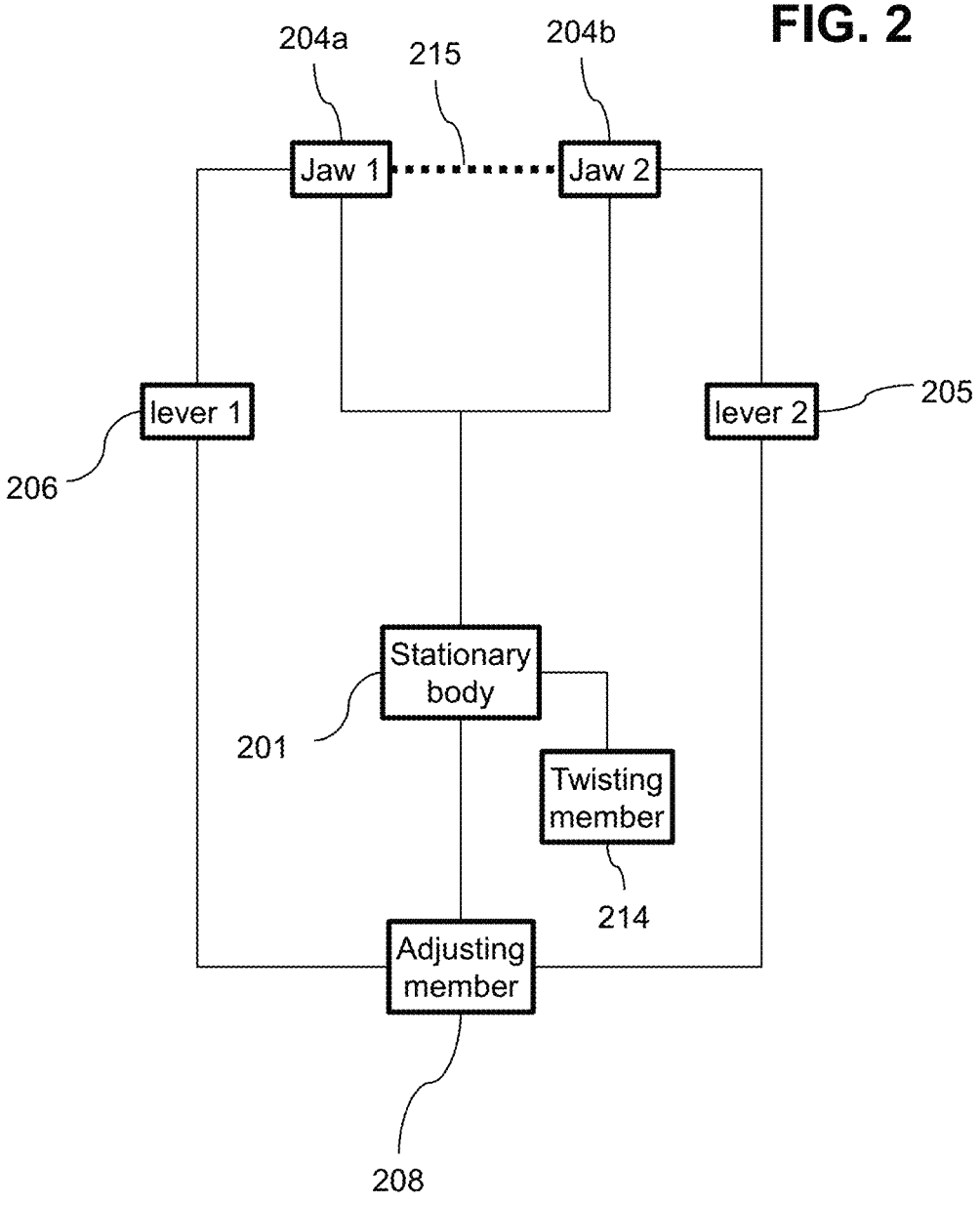
FIG. 2 is a block diagram of a locking pliers wrench in accordance with an embodiment of the current invention.

FIG. 2 is a block diagram of a locking pliers wrench in accordance with an embodiment of the current invention. For example, the pliers wrench of FIG. 2 may be used to perform the method describe in FIG. 1. In some embodiments, a pair of pliers includes a pair of jaws 204*a*, 204*b*. Optionally, one and/or both of the jaws is connected to a body 201 by a pivot and/or a locking mechanism including a lever 205 and/or 206. For example, closing one or more levers 205 and/or 206 closes and/or locks a respective jaw 204*a* and/or 204*b*. Optionally, the jaws close and/or lock around a gap 215. For example, an adjusting member 208 may be supplied to adjust a size of the gap 215. In some embodiments, when the jaws 204*a*, 204*b* are closed, a central axis of the gap remains fixed with respect to the body 201 of the pair of pliers over a range of gap sizes. For example, the central axis of the gap may correspond to an axis of the body 201 over the range of gap sizes (for example as specified above). In some embodiments, a twisting member 214 facilitates rotation of the body 201 and/or jaws 204*a*, 204*b* around a rotational axis and/or the longitudinal axis of the body 201. For example, the twisting member may include a ratchet and/or a hex head (or another screw head) configured for grabbing and/or twisting the body 201 around the axis and/or positioned symmetrically around the axis. Alternatively or additionally, a locking pliers may lack a central body. In such an embodiment, the jaws may be symmetrically positioned around a rotational axis of the pair of pliers when they lock to various gap sizes.

In some embodiments, the locking mechanism includes lever 205, 206 and/or a link. For example, jaws 204*a* and 204*b* may be connected to body 201 by symmetrical pivots and/or locking mechanisms, such the adjustment member 208 symmetrically adjusts the closing position of both jaws 204*a* and 204*b* synchronously. Optionally, jaws 204*a* and/or 204*b* may be configured to grasp a screw head. For example, one or both jaws 204*a*, 204*b* may include a notch. Optionally, the notch may include a 120-degree angle, for example for grasping a hex head bolt. Alternatively or additionally, an exchangeable accessary may be supplied for rotating different objects. For example, a screw driver tip may be attached to a body configured for grasping by the jaws 204*a*, 204*b*. Optionally, a screw may be grasped coaxially to the rotational axis.

In some embodiments, the current invention includes a plier with a locking spring mechanism adjusted by a screw. The locking spring mechanism optionally allows for more powerful locking the plier than by hand alone. Pliers are optionally made of steel and/or a steel alloy. For example, the steel may be combined with additional materials such as vanadium and chrome for example the materials may promote solidification and/or prevent rust.

Figure 3:
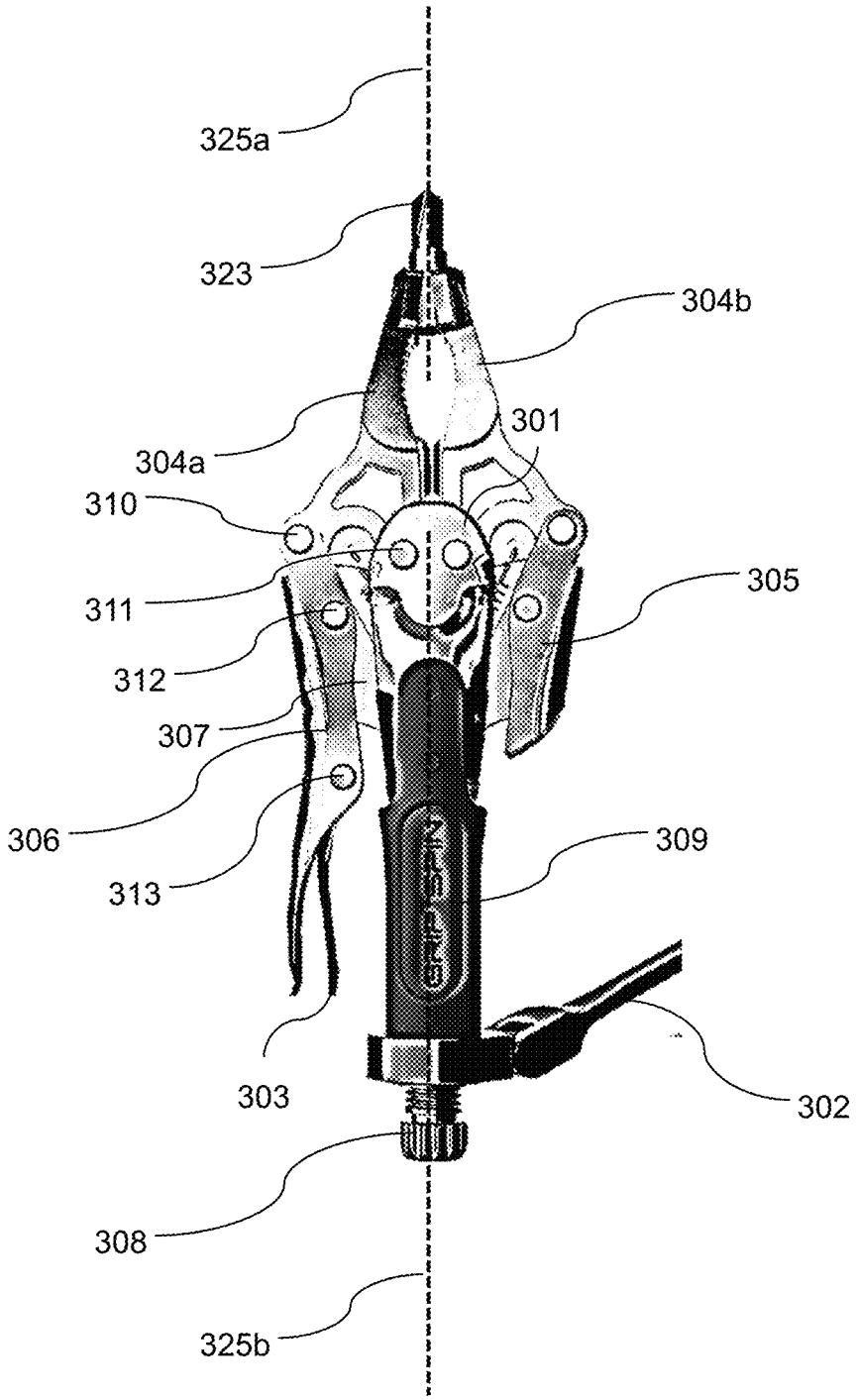
FIGS. 3, 4 and 5 are orthogonal, exploded and perspective views of a locking pliers wrench in accordance with an embodiment of the current invention.
Figure 4:
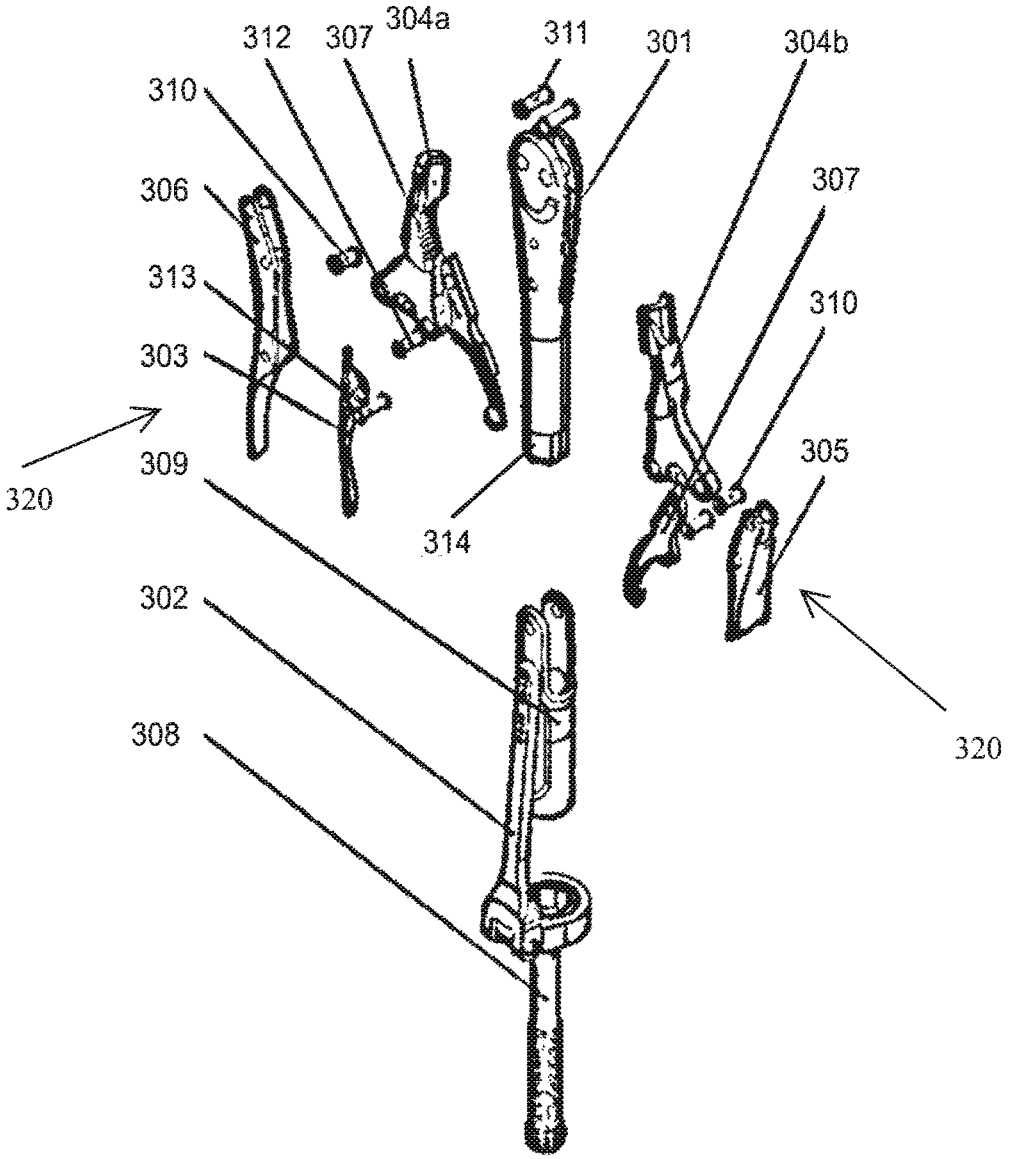
Figure 5:
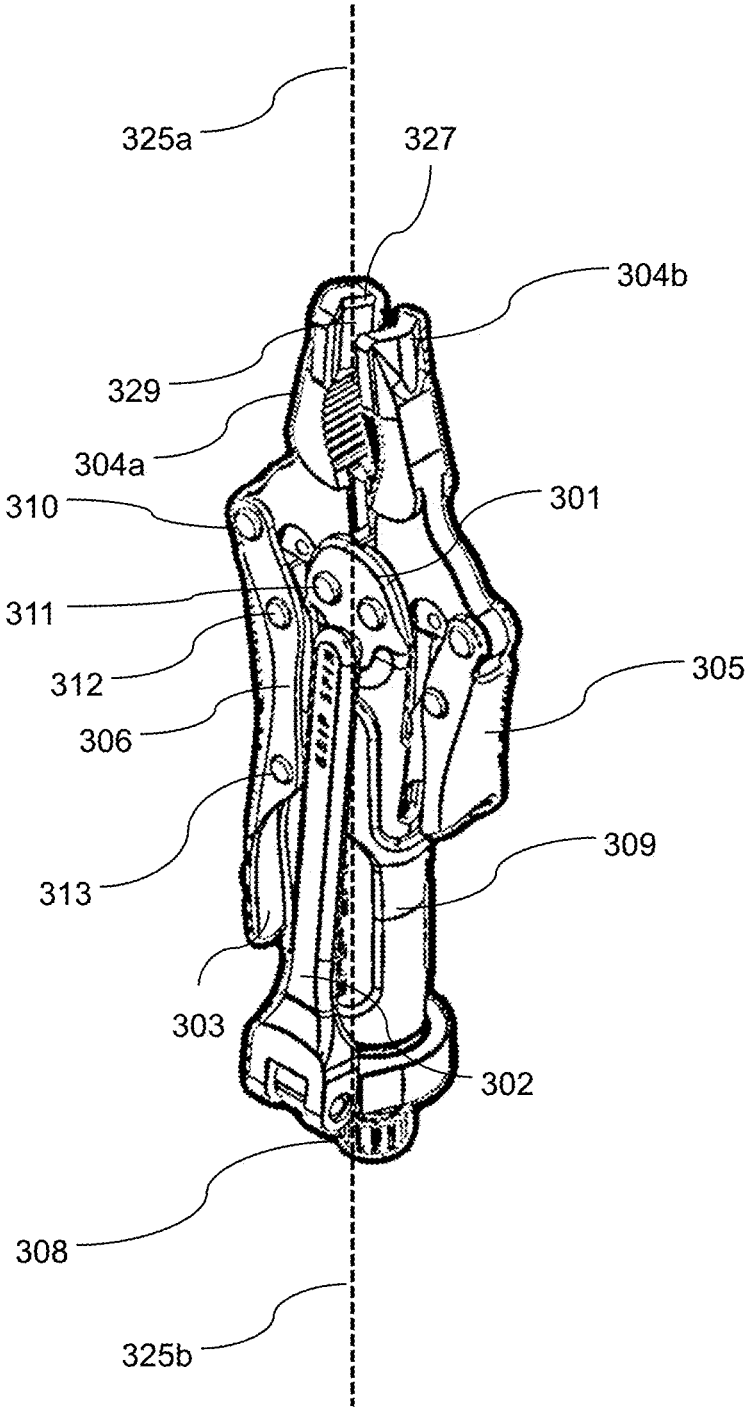

FIGS. 3, 4 and 5 are orthogonal, exploded and perspective views respectively of a locking pliers wrench in accordance with an embodiment of the current invention. For example, the pliers of FIGS. 3-5 may be used to perform the method of FIG. 1 and/or may be an example of the embodiment described in FIG. 2. In some embodiments, a pair of jaws 304*a* and 304*b* are rotationally connected to a body 301 by respective pivots 311. Optionally the jaws 304*a* and 304*b* are configured closed to a locked position. Optionally in the locked position there may remain a gap between the jaws 304*a* and 304*b*. For example, the width of the gap may be adjusted using an adjusting element (e.g. screw 308). Optionally, over a range of gap sizes, when both jaws 304*a* and 304*b* are closed, an axis 325*a* of the gap remains stationary and/or aligned (e.g. coaxial) with a rotational axis 325*b* of the plier. Optionally, the pivots 311 of the jaws 304*a*, 304*b* are arranged symmetrically about axis 325*b*.

In some embodiments, jaws 304*a* and 304*b* are symmetrically connected by two symmetrically positioned pivots 311 to a body 301 (for example, in the context of FIG. 3 symmetrically may be defined as symmetrically positioned on opposing sides of longitudinal axis of body 301 and/or as symmetrically positioned on opposing sides of rotational axis 325*b* for example rotational axis 325*b* may correspond to the longitudinal axis of body 301). Additionally or alternatively, a closing position of both jaws 304*a*, 304*b* may be adjusted simultaneously and/or symmetrically with regard to the body 301 using adjuster screw 308. For example, screw 308 is connected by threading to body 301 such that turning screw 308 advances and/or retracts screw 308 distally towards jaws 304*a*, 304*b* and/or proximally away from jaws 304*a*, 304*b*. Optionally, screw 308 pushes a symmetrical pair of rocker links 307 on either side of body 301 and/or rotational axis 325*b*. Each rocker link 307 is connected to a lever handle 305, 306 via symmetrical pivots 312. In turn, handles 305 and 306 are optionally connected by symmetrical pivots 310 to jaws 304. For example, adjusting screw simultaneously and/or symmetrically adjusts jaws 304*a* and 304*b* synchronously. Optionally handles 305 and 306 may be situated on opposite sides of a rotational axis 325*b*.

In some embodiments, handles 305 and/or 306 move independently of each other. For example, as handle 306 is rotated around its respective pivot 310 it operates to open and/or to close jaw 304*a* and/or as handle 305 is rotated around its respective pivot 310 it opens and/or closes jaw 304*b*. Additionally or alternatively, handles 305 and 306 may differ. For example, handle 306 is longer and/or easer to manipulate than handle 305. To grasping an object with jaws 304*a*, 304*b*, a user optionally opens one jaw 304*a*. The object is optionally positioned between the jaws 304*a*, 304*b* while jaw 304*a* is in an open position and jaw 305*b* is in its closed and/or locked position. Optionally jaw 304*a* is then closed to grasp the object and/or align the object to the rotational axis 325*b*. Additionally or alternatively, rocker links 307 and/or jaws 304*a*, 304*b* and/or pivot points 310, 311, 312 are symmetrical. For example, symmetry may be around axis 325*b* of body 301 such when both jaws are in a fully open and/or closed positions of jaws 304*a* and 304*b* remain symmetrical around axis 325*b* as the gap size is adjusted.

The positions of handles 305, 306 and/or rocker links 307 and/or jaws 304*a*, 304*b* and/or pivot points 310, 311, 312 are optionally configured to multiply a force applied to a lever handle 305 and/or 306 to a much higher closing force (e.g. at the closing point) on jaws 304*a*, 304*b* (for example 2 to 3 times and/or 3 to 8 times and/or 8 to 15 times and/or more than 15 times). Optionally, in a closed position jaws 304*a*, 304*b* are locked. For example, at the closed position, rocker links 397 may be parallel to handles 305, 306 and/or reversed from their orientation to handles 305, 306 with respect to the open position. Optionally, one or both handles 305, 306 includes a release lever 303. For example, lever 303 rotates around a pivot 313 on handle 306 to push against rocker link 307 and/or release handle 303 from a locked position. A separate closing mechanism 320 is represented on one side of the wrench by lever handle 305, rocker links 307, and pivot point 310; and on the other side by release lever 303, handle 306, rocker link 307, pivot point 310, and pivot 313.

In some embodiments, jaws 304*a*, 304*b* may be used to grasp an object. For example, jaws 304*a*, 304*b* may be used to grasp a screw driver bit 323. Optionally, the bit 323 includes a fitting that matches jaws 304*a*, 304*b* facilitating grasping bit 323 coaxial to axis 325*b*. For example, bit 323 may include a hexagonal fitting and/or jaws 304*a*, 304*b* may include aligned notches 327, for example with a 120-degree angles that hold the bit coaxial to body 301. Optionally, while grasping bit 323 with jaws 304*a*, 304*b*, the distal end of the bit 323 is coupled to a screw head and/or the pliers are rotated around axis 325*b* thereby rotating bit 323 and/or the screw.

In some embodiments, a pair of pliers may include a twisting member. For example, the twisting member may include features and/or attachments to facilitate rotating the pliers. For example, the pliers may be rotated about axis 325*b*. For example, a ratchet mechanism 309 may be attached to body 301. Optionally, a torque arm 302 may be attached to ratchet 309 and/or body 301. Alternatively or additionally, body 301 and/or ratchet 309 may include a fitting (such as a hexagonal fitting 314 for grasping by a wrench and/or a socket). In some embodiments, the torque arm 302 is permanently attached to the body 301 of the wrench. Alternatively or additionally, the torque arm 302 may be reversibly attached to the body 301. For example, fitting 314 may be located on a proximal (backside) of body 301 and/or be centered on axis 325*b* and/or with respect to adjustment screw 308. Fitting 314 may optionally be integrated into the main body 301 and/or used to rotate the plier. For example, rotation can be achieved using an external ratchet key as an addition to the tool or by means of a built in, internal ratchet mechanism. Optionally, a ratchet may be a permanent part of the pliers and/or part of an attachment (e.g. a torque arm and/or a socket wrench etc.) used to rotate the plier.

In some embodiments, a pair of pliers in accordance with the current invention combines a large number of uses in one tool. For example, it may replace several tools. Some embodiments are designed to grip and turn a variety of sizes of nuts and/or bolts and/or pipes and/or profiles. For example, pliers according to some embodiments of the current invention may be used for metric and/or English fittings without duplicate sets of tools. A tool in accordance with some embodiments of the current invention may be integrated into a very large and developing industry in the field of hand tools, and/or may replace a large number of tools used in professional garages and/or at homes, i.e.—Do it yourself (DIY) uses.

In some embodiments, implicitly and/or conceptual sophistication combined with mechanical engineering are manifested and/or executed to design and produce a tool with a very high-quality finishing, including mechanics and/or advanced materials and/or designated materials suitable in terms of strength and weight to produce an innovative and superior device.

FIG. 6 is a perspective close up view of jaws of a locking pliers wrench in accordance with an embodiment of the current invention. In the view gap 329 and notches 327 are seen clearly.

FIG. 7 is a cross sectional side view of a locking pair of pliers in accordance with an embodiment of the current invention. One or more springs 331 optionally hold jaws 304*a*, 304*b* open until handle 306 and/or 305 respective are closed.

In some embodiments, there may be a mechanism that locks the jaws. For example, the shape of the, the shape of the rocker links 307 and/or handles 305, 306 may cause the jaws 304*a*, 304*b* to lock automatically upon closing. Optionally, each jaw 304*a* locks into a closed position when it is moved to a closed position, independent of the position of the other jaw 304*b*. Additionally or alternatively, both jaw 304*a*, 304*b* may lock automatically (e.g. grasping an object) when they are both closed simultaneously. Alternatively or additionally, there may be a manual locking mechanism that locks the jaws when the user takes an action to lock the jaws. For example, there may be a catch (e.g. a hook and/or a barb and/or an interference element and/or a switch) to hold one or more of handle 305, 306 in a closed position.

Figure 8A:
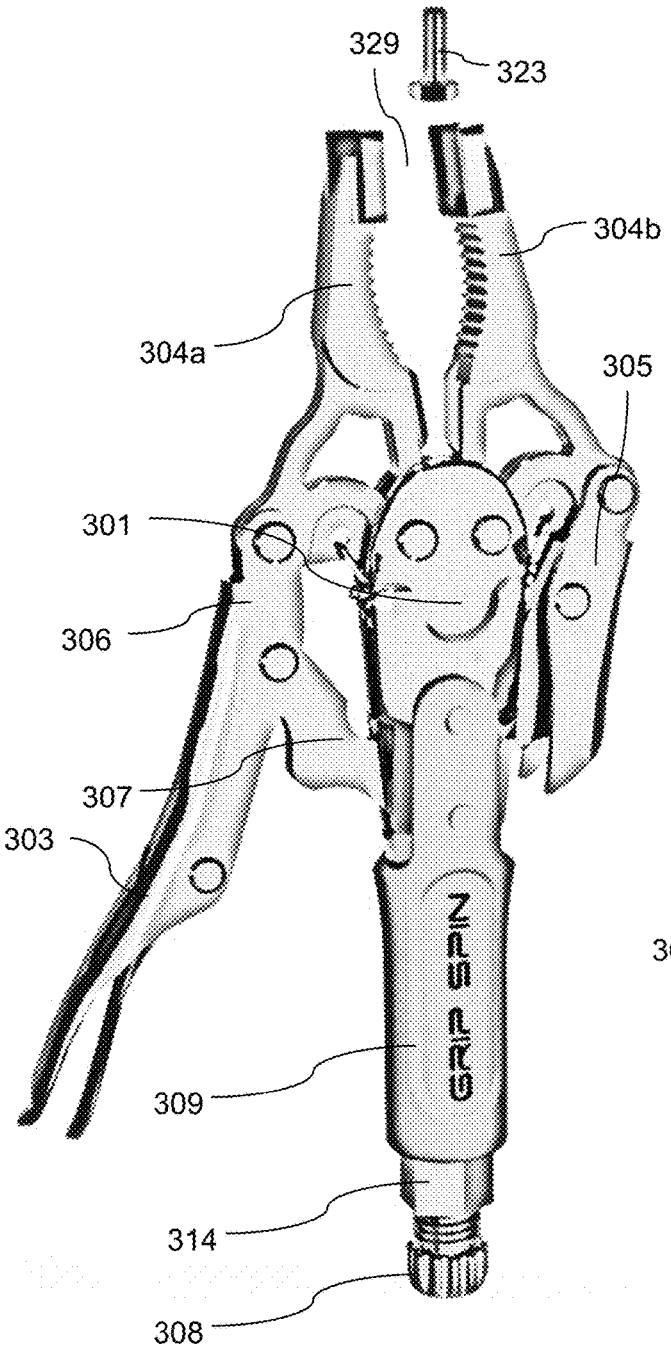
FIGS. 8A and 8B illustrate grasping an object with a pair of pliers in accordance with an embodiment of the current invention
Figure 8B:
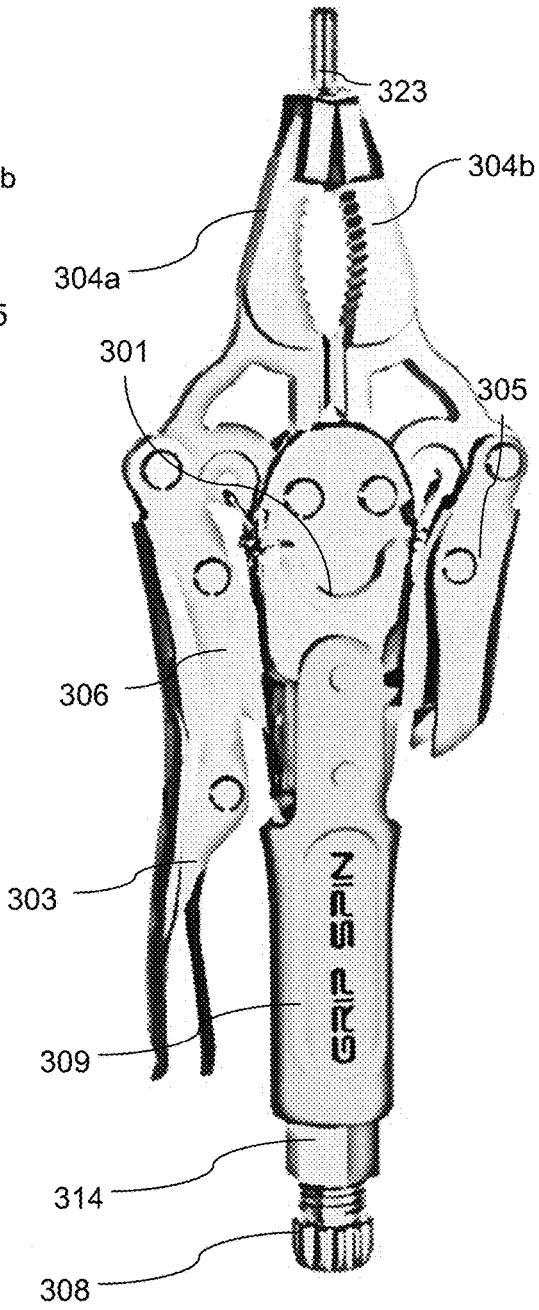

FIGS. 8A and 8B illustrate grasping an object with a pair of pliers in accordance with an embodiment of the current invention. For example, as illustrated in FIG. 8A, in some embodiments, before grasping the object 323, jaw 304*b* and short handle 305 are in the closed and/or locked position while the other jaw 304*a* and handle 306 are in the open position. In some embodiments, when one jaw 304*a* is open and the other jaw 304*b* is closed, the gap between the jaws is not coaxial with the body 301 of the pair of pliers, for example as illustrated in FIG. 3A.

In some embodiments, for example, as illustrated in FIG. 8B, once the object 323 is positioned between the jaws 304*a*, 304*b* and/or jaw 304*a* is closed (leaving both jaws closed and/or locked). Optionally, when both jaws 304*a* and 304*b* are closed the object is held coaxial with the axis of the gap and/or the rotation al axis of the pair of pliers.

In some embodiments, a double and/or symmetrical adjustment mechanism can grip firmly, lock and/or rotate a large variety of elements. Optionally, in its locked position the jaws of the pair of pliers are aligned with a rotation axis of the pair of pliers. Optionally, the center of the gripped element's is aligned thereby with a rotational axis of the pair of pliers (optionally the rotational axis of the pair of pliers may correspond to an axis of symmetry of the jaws and/or a longitudinal axis of the pair of pliers). A method optionally includes the opening and/or closing of screw and/or nut heads with a pair of pliers having a unique double adjustment mechanism. Optionally, a pair of pliers includes a double-edged jaw surfaces at 120-degree angles (for example on each side of a slot). For example, this gives a good grip of a hex head nut and/or screw and/or hose fitting. For example, the jaws are adjusted to hold tight to the fitting in the locked position. For example, the fitting is held with a rotation axis of the fitting coaxial with a rotational axis of the pair of pliers.

In some embodiments, the central body include symmetrical pivots that facilitates adjusting the jaws symmetrically along the rotation axis and/or centers the grip. For example, the pair of pliers may include:

- two locking mechanisms;
- jaws with edges cut at a 120 degrees' angle;
- a screw to the body for symmetrical adjustment of the tool's adjustment arms sides and/or jaws when locked; and/or
- a closed ring ratchet key with a ratchet mechanism that rotates the central body, thereby, also—the edges of the tool and/or ratchet; and/or
- a torque handle built into the body of the tool.

In some embodiments a pair of pliers in accordance with the present invention facilitates rotation of a grasped object. For example, a double adjusting jaw mechanism keeps the axis of the jaws and/or the gripped object and/or a longitudinal axis of the gripped object coaxial and/or aligned with a rotational axis of the pair of pliers. Optionally, A ratchet key is attached to the profile in the back of the tool as an integral part of the device or as an external one.

In some embodiments, the pair of pliers may be used for gripping and rotating multiple element profiles of different sizes. The jaws with a 120-degree angle profile, may be combined with an adjustment to provide a solution for a wide range of sizes and shapes uses.

In some embodiments, in the locked position, the jaws stay symmetrical with respect to a rotational axis of the pair of pliers for a range of adjustments and/or positions of the adjustment screw. One or two jaws are optionally moved inward to grasp an object by pressing a lever handle on the side of the tool. Optionally the tool can be used to grasp an object and/or rotate the object 360 degrees. Embodiments may include an integral (and/or external) extension of a ratchet mechanism. A key and/or torque arm optionally attaches to the body of the main tool. For example, the tool can be used to rotate the gripped element in both directions.

In some embodiments, a pair of pliers in accordance with the current invention may be used for a variety of nuts and bolts of different sizes and shapes. For example, this is facilitated by a 120-degree edge structure that provides grips of a very wide range of sizes and shapes. An optional double locking mechanism may facilitate a symmetrical grip and/or a strong and steady one.

Figure 9A:
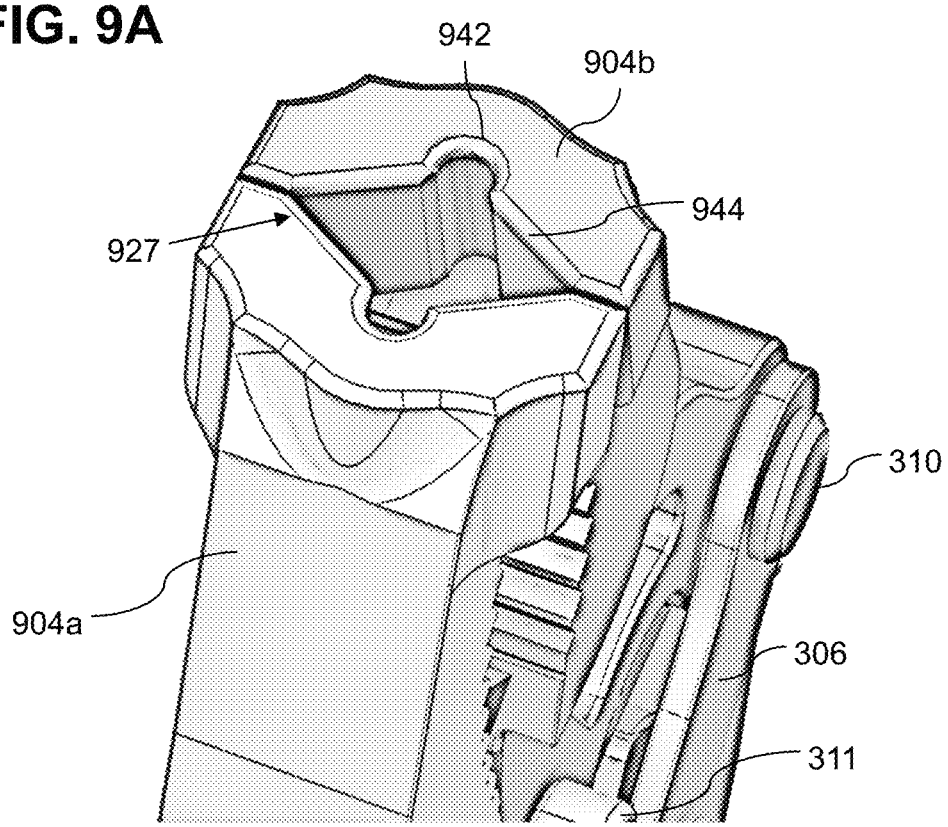
FIGS. 9A and 9B are perspective illustrations of plier jaws in accordance with an embodiment of the current invention.
Figure 9B:
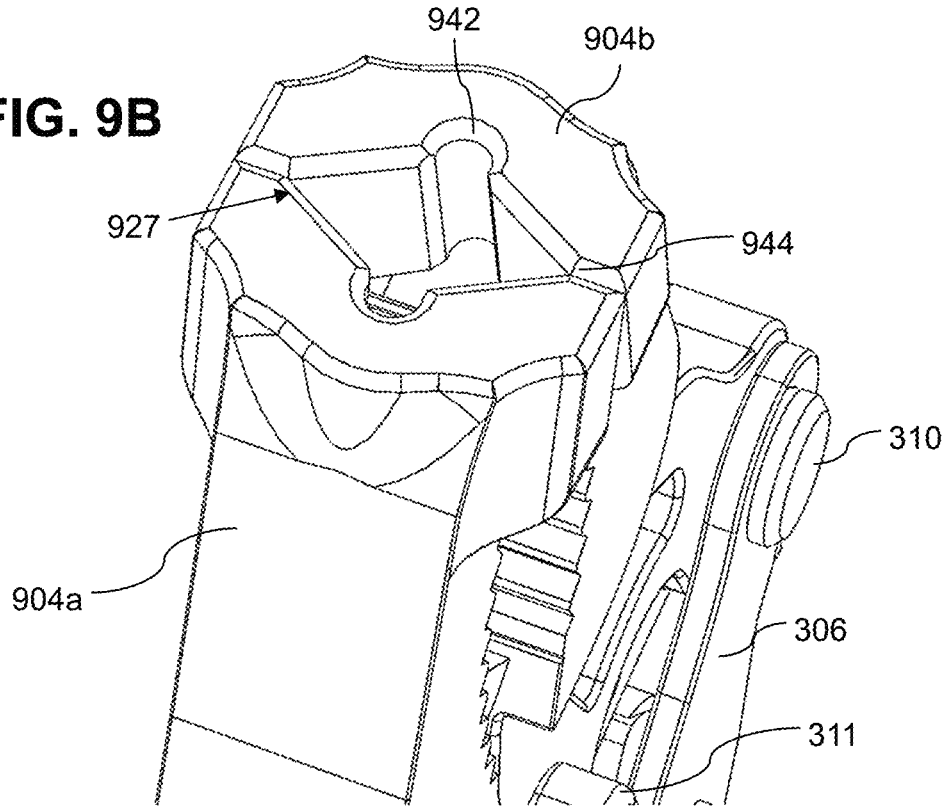
Figure 10:
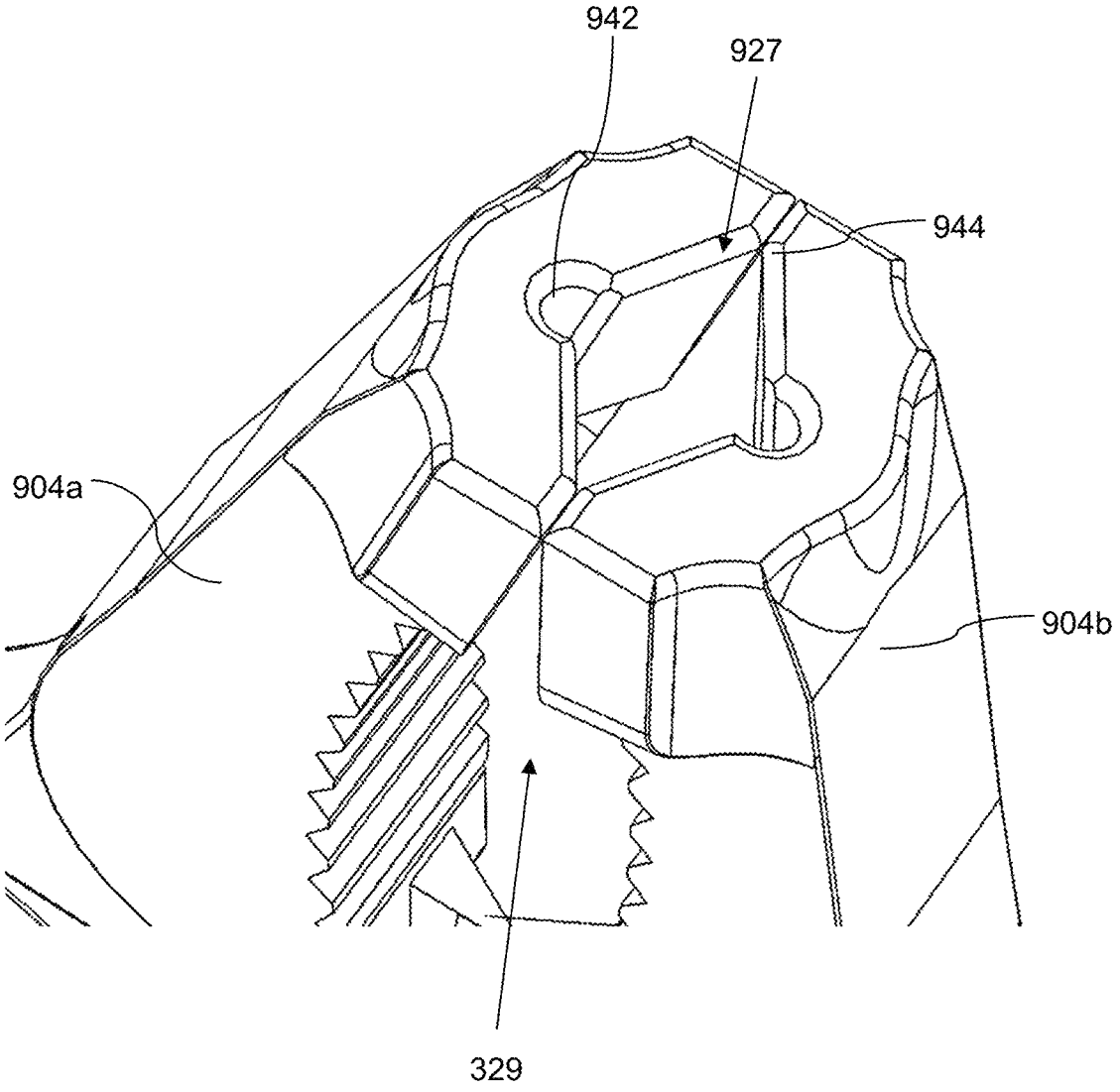
FIG. 10 is a perspective illustration of a plier jaw in accordance with an embodiment of the current invention.

FIGS. 9A and 9B are perspective illustrations of plier jaws in accordance with an embodiment of the current invention. FIG. 10 is a perspective illustration of a plier jaw in accordance with an embodiment of the current invention. In some embodiments, a notch 927 is designed to grip and/or apply torque to a fitting (for example a hexagonal bolt head) may include features to improve grip and/or prevent damage to the fitting. In some embodiments, the notch and/or jaws of the pliers may be designed to distribute stress more evenly on a fitting. Optionally, a contact point and/or high stress location may include a stress release geometry. For example, an inner corner of the notch may include a removed section 942. For example, the removed portion 942 at the inner corner of the notch which grasps the corner of the a hex head fitting may lower the stress on the corners of the fitting and/or cause the stress to be distributed more evenly and/or over a greater portion of the fitting.

In some embodiments, an edge 944 of a notch 927 and/or an edge 944 of the jaws 904*a*, 904*b* of a wrench may be rounded and/or beveled. For example, the rounded edge 944 may allow the jaws 904*a*, 904*b* of the wrench to fully contact a fitting and/or engage a surface of a fitting when the jaws are not parallel (for example, when the wrench is set larger and/or smaller than the fitting.

Figure 11:
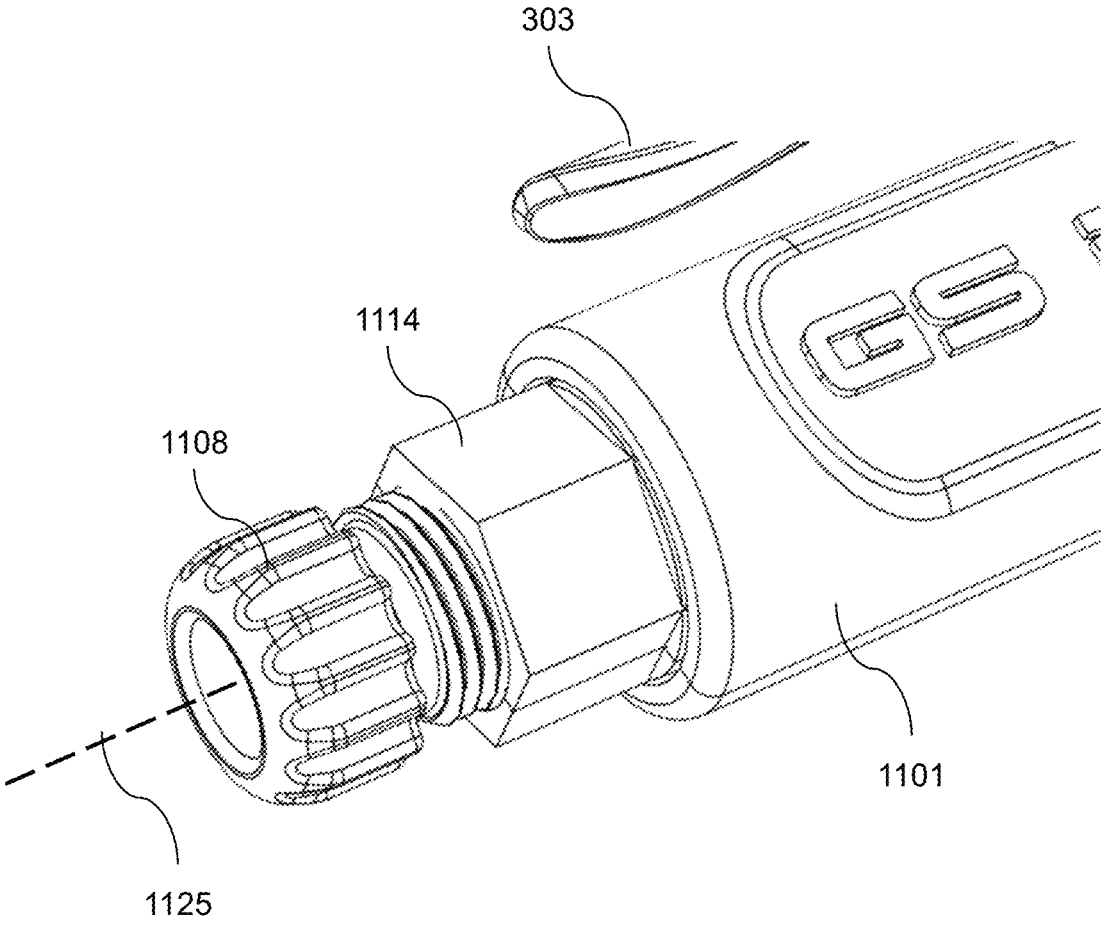
FIG. 11 is a perspective view of a mechanism and a torque fitting for a wrench in accordance with an embodiment of the current invention.

FIG. 11 is a perspective view of a mechanism and a torque fitting for a wrench in accordance with an embodiment of the current invention. In some embodiments, a pair of pliers may include a twisting member. For example, the wrench body 301 and/or ratchet may include a fitting (such as a hexagonal fitting 1114 for grasping by a standard wrench and/or a socket). For example, fitting 1114 may be located on a proximal (backside) of body 1101. For example, the fitting 1114 may be centered on and/or coaxial to an axis 1125 of the pliers and/or with respect to an adjustment screw 1108. For example, the twisting member may include features and/or attachments to facilitate rotating the pliers. For example, a ratchet mechanism may attach a fitting 1114 to body 1101 of the wrench and/or to the jaws of the pliers. Optionally, the internal ratchet mechanism of the pliers facilitates rotating the pliers around its axis with a convenient back and forth rotational motion of a tool, for example, a simple wrench may be connected to the fitting 1114 to rotate the pliers with a back and forth rotational motion of the wrench. For example, twisting adjustment screw 1108 may adjust the size of the opening of the pliers. Fitting 1114 may optionally be integrated into the main body 1101 and/or be used to facilitate rotation of the plier. Optionally, there may be a handle on the body to reverse the direction of and/or lock the ratchet and/or there may be a knob coaxial to the fitting by which one can reverse the direction of and/or lock the ratchet. Alternatively or additionally, rotation can be achieved using an external ratchet key as an addition to the tool or by means of a built in, internal ratchet mechanism. Optionally, a ratchet may be a permanent part of the pliers and/or part of an attachment (e.g. a torque arm and/or a socket wrench etc. [e.g. adjustor 1108 may be narrower than fitting 1114 such that a deep socket can fit over adjuster 1108 and grasp fitting 1114]) used to rotate the plier. In some embodiments, the pliers may not include a ratchet.

Figure 12A:
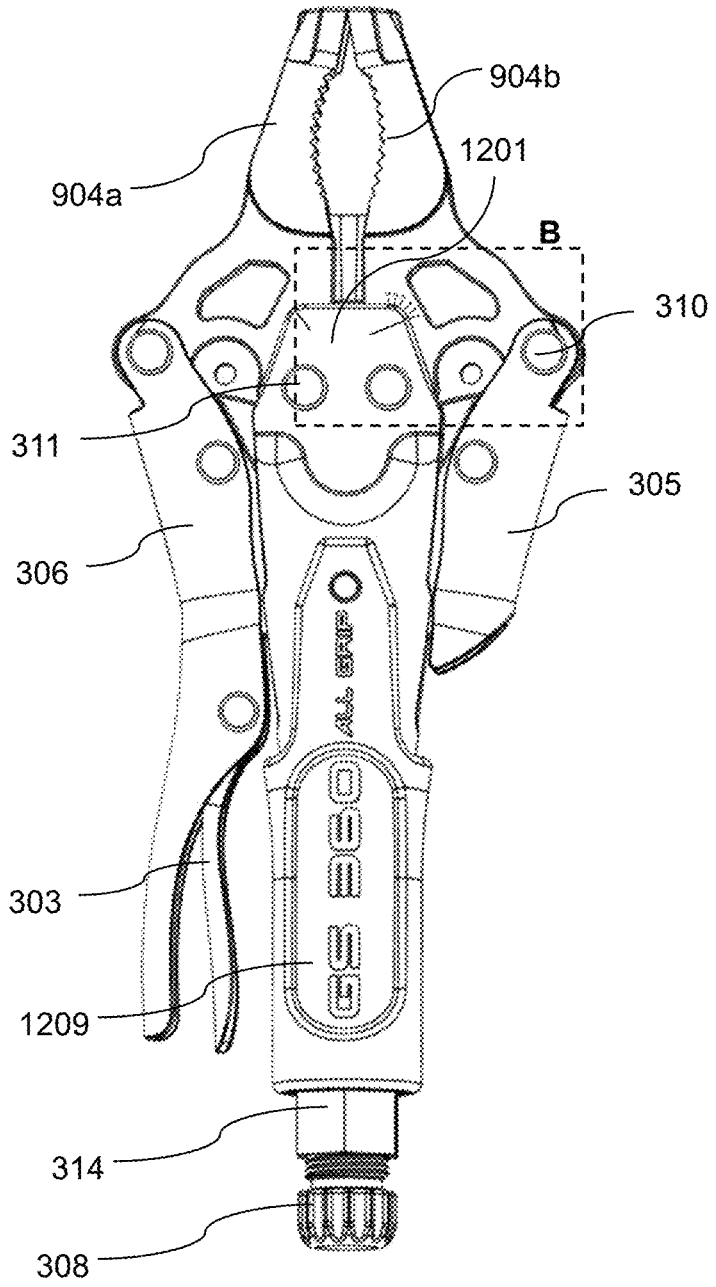
FIG. 12A is an illustration of a calibrated pliers in accordance with an embodiment of the current invention.
Figure 12B:
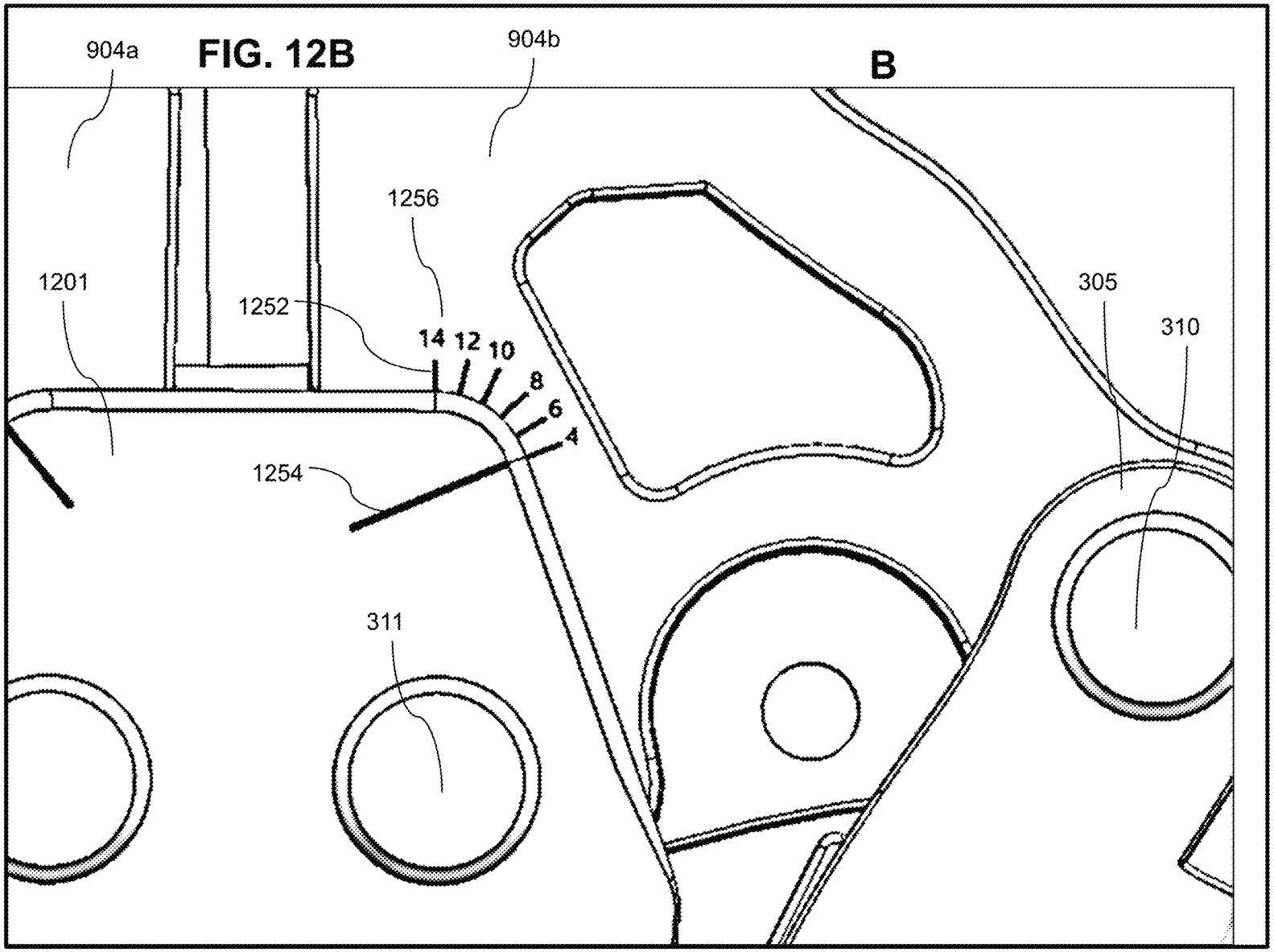
FIG. 12B is a close up illustration of section B of a calibrated pliers in accordance with an embodiment of the current invention.

FIG. 12A is an illustration of a calibrated pliers in accordance with an embodiment of the current invention. FIG. 12B is a close up illustration of section B of a calibrated pliers in accordance with an embodiment of the current invention. In some embodiments a pliers with include graduation markings 1252 according the angle between the jaws 904*a*, 904*b* and/or between one or both jaws 904*a*, 904*b* and the body 1201 of the pliers. Optionally, the markings 1252 includes labels 1256. For example, labels may indicate a distance between the jaws and/or a size of an object that fits between the jaws. The measurement system may optionally used on various different kinds of pliers. For example, the graduation markings 1252 may line up with a matching mark 1254 to show the size of the opening in the pliers. For example, the matching mark 1254 may be on the body 1201 of the pliers and/or the graduation marks may be on a jaw 904*b* of the pliers. Alternatively or additionally, the matching mark 1254 may be on a jaw 904*b* of the pliers and/or the graduation marks may be the body 1201 of the pliers. For example, the graduations mark 1252 that lines up with the matching mark 1254 may indicate an angle between the body 1201 and the jaw 904*a*. Optionally, the graduations marks 1252 may be labelled by the distance between the closest surface of the jaws 904*a*, 904*b* and/or the size of an object held in the notch of the jaws when both jaws are closed symmetrically. Optionally, the indicated size of the object may be slightly larger than the distance between the jaws 904*a*, 904*b* and/or notches 927 to allow for compression of the jaws 904*a*, 904*b* on the object.

In some embodiments, graduation marks may be on one jaw 904*a* may line up with a matching mark on the other jaw 904*b*. Alternatively or additionally, there may be Vernier scale and/or a second set of graduations, for example in place of the matching mark 1254. In some embodiments, there may be multiple scales. For example, on one jaw 904*b* there may be graduations for a set of distances (e.g. even graduations of millimeters) and/or on the other jaw there may be graduations of intervening distances (e.g. odd graduations of millimeters) for example to facilitate readings of more precise distances. Optionally, marking may be supplied on opposite sides (faces) of a jaw and/or the body and/or the pliers. For example, on one side the pliers, labels may indicate one scale (e.g. metric), while on the other side, the labels may indicate another scale (e.g. English).

Figure 13:
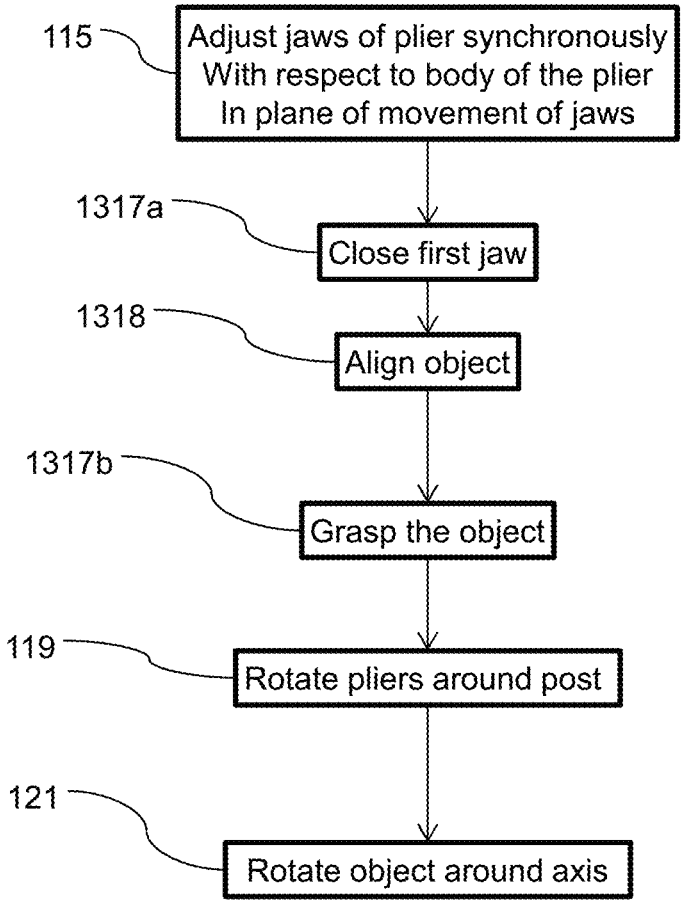
FIG. 13 is a flow chart illustration of rotating an object in accordance with an embodiment of the current invention.

FIG. 13 is a flow chart illustration of grasping and/or rotating an object in accordance with an embodiment of the current invention. In some embodiments, a user may close 1317*a* and/or lock a first jaw; for example, jaw 904*b* which is connected to a short handle 305 may be closed first. Then the user optionally aligns 1318 the object to be grasped 1317*b* with the closed jaw 904*b*. For example, a fitting of the object may be positioned into a fitting groove 927 of the locked jaw. Optionally, the object may be moved to align 1318 it with the closed jaw 904*b*. Alternatively or additionally, the pliers may be moved to align 1318 the closed jaw 904*b* with the object. Then the user optionally grasps 1317*b* the object, for example by closing and/or locking the second jaw 904*a*, grasping 1317*b* the object between the first jaw 904*b* and second jaw 904*a*.

It is expected that during the life of a patent maturing from this application many relevant technologies will be developed and the scope of the terms in the application are intended to include all such new technologies a priori.

As used herein the term "about" refers to 10%

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A method of rotating an object comprising:

adjusting a locking pair of pliers to lock with a gap between closed jaws of the pair of pliers fitting the object while keeping the gap aligned with a rotational axis of the pair of pliers said pair of pliers including a torque fitting coaxial to said rotational axis;

closing the jaws symmetrically with respect to said rotational axis onto the object with the object coaxial with respect to said rotational axis of the pair of pliers; and grasping said torque fitting with a standard wrench and rotating the object with said standard wrench;

wherein said torque fitting is connected to said pair of jaws via a ratchet where said rotating includes a back and forth motion which is converted to rotating by said ratchet.

2. The method of claim 1, wherein each jaw of said jaws is linked to an associated separate handle of a pair of handles and wherein said closing includes closing a first said separate handle and an associated first jaw of said pair of jaws independently from a second said separate handle and independently from an associated second jaw of said pair of jaws.

3. The method of claim 2, further comprising:

locking said first jaw in a closed position automatically upon said closing said first separate handle independently from said second separate handle.

4. The method of claim 1, further comprising: wherein said closing includes rotating at least one jaw of said jaws around a pivot.

5. The method of claim 4, wherein said pair of pliers include a body and said pivot attaches said at least one jaw to said body of said pair of pliers.

6. The method of claim 5, wherein said rotational axis is a longitudinal axis of said body and said rotating includes rotating around said longitudinal axis of said body.

7. The method of claim 1, wherein said pair of pliers include a body and each jaw of said jaws is attached to said body by a respective pivot and where a first said respective pivot is situated symmetrically opposite a second said respective pivot with respect to said rotational axis and wherein said closing includes rotating at least one of said jaws around said respective pivot of said at least one jaw.

8. The gripping tool of claim 1, further comprising markings indicating a size of a gap between said pair of jaws.

9. The gripping tool of claim 8, wherein said markings indicate an angle between a jaw of said pair of jaws and a body of the pliers.

10. The pipping tool of claim 9, wherein the markings are labelled with the size of a fitting that fits between said pair of jaws.

11. A method of rotating an object comprising:

adjusting a locking pair of pliers to lock with a gap between closed jaws of the pair of pliers fitting the object while keeping the gap aligned with a rotational axis of the pair of pliers said pair of pliers including a torque fitting coaxial to said rotational axis;

closing the jaws symmetrically with respect to said rotational axis onto the object with the object coaxial with respect to said rotational axis of the pair of pliers; and grasping said torque fitting with a standard wrench and rotating the object with said standard wrench, wherein said jaws include a notch having a 120 degree angle and a curved edge, the method further comprising:

holding a hexagonal fitting of said object against said curved edge when said pair of jaws are not parallel.

* * * * *